US008100554B2

(12) United States Patent
Wei et al.

(10) Patent No.: US 8,100,554 B2
(45) Date of Patent: Jan. 24, 2012

(54) LIGHT SOURCE HOLDER AND BULB USING SAME

(75) Inventors: An-Chi Wei, Miao-Li Hsien (TW); Ying-Chieh Lu, Miao-Li Hsien (TW); Yu-Shu Chen, Miao-Li Hsien (TW); Ji-Min Lo, Miao-Li Hsien (TW); Kuo-Feng Chiang, Miao-Li Hsien (TW); Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 322 days.

(21) Appl. No.: 12/555,884

(22) Filed: Sep. 9, 2009

(65) Prior Publication Data

US 2010/0290223 A1 Nov. 18, 2010

(30) Foreign Application Priority Data

May 13, 2009 (CN) ..... 200910302261.8

(51) Int. Cl.
*F21V 7/00* (2006.01)

(52) U.S. Cl. ..... 362/241; 362/249.06

(58) Field of Classification Search ..... 362/241, 362/249.02, 249.06
See application file for complete search history.

(56) References Cited

U.S. PATENT DOCUMENTS

| | | | | |
|---|---|---|---|---|
| 5,806,965 | A * | 9/1998 | Deese | 362/249.04 |
| 6,220,722 | B1 * | 4/2001 | Begemann | 362/231 |
| 6,854,871 | B1 * | 2/2005 | Morton | 362/565 |
| 2007/0291482 | A1 * | 12/2007 | Baroky et al. | 362/227 |
| 2010/0290228 | A1 * | 11/2010 | Chern et al. | 362/249.02 |

FOREIGN PATENT DOCUMENTS

| | | |
|---|---|---|
| CN | 2031966 | 2/1989 |
| CN | 2443228 | 8/2001 |
| CN | 1948819 | 4/2007 |

* cited by examiner

*Primary Examiner* — David V Bruce
(74) *Attorney, Agent, or Firm* — Altis Law Group, Inc.

(57) ABSTRACT

A light source holder includes a spherical surface and a number of recessed portions. The recessed portions are defined in the spherical surface and arranged substantially evenly over the spherical surface. Each of the recessed portions comprises a plurality of inner surfaces. The inner surface of each recessed portion comprises a bottom surface and a lateral reflective surface. The bottom surface is capable of having a solid-state light source arranged thereon. The lateral reflective surface is adjacent to the bottom surface and configured for reflecting light emitted from the solid-state light source and outputting the light from the recessed portion.

19 Claims, 6 Drawing Sheets

LIGHT SOURCE HOLDER AND BULB USING SAME

BACKGROUND

1. Technical Field

The disclosure generally relates to light source holders, and particularly to a light source holder for holding a plurality of solid-state light sources thereon.

2. Description of Related Art

Light emitting diodes (LEDs) have recently been extensively used as light sources for illumination devices due to their high luminous efficiency, low power consumption and long lifespan. A single LED generally has a limited radiating range. To achieve a large radiating range, some illumination devices employ a holder which has a plurality of LEDs mounted thereon. However, such a structure may direct light in undesired directions, which results in low light utilization efficiency.

Therefore, what is needed is a light source holder for holding light sources thereon that overcomes the described limitations.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
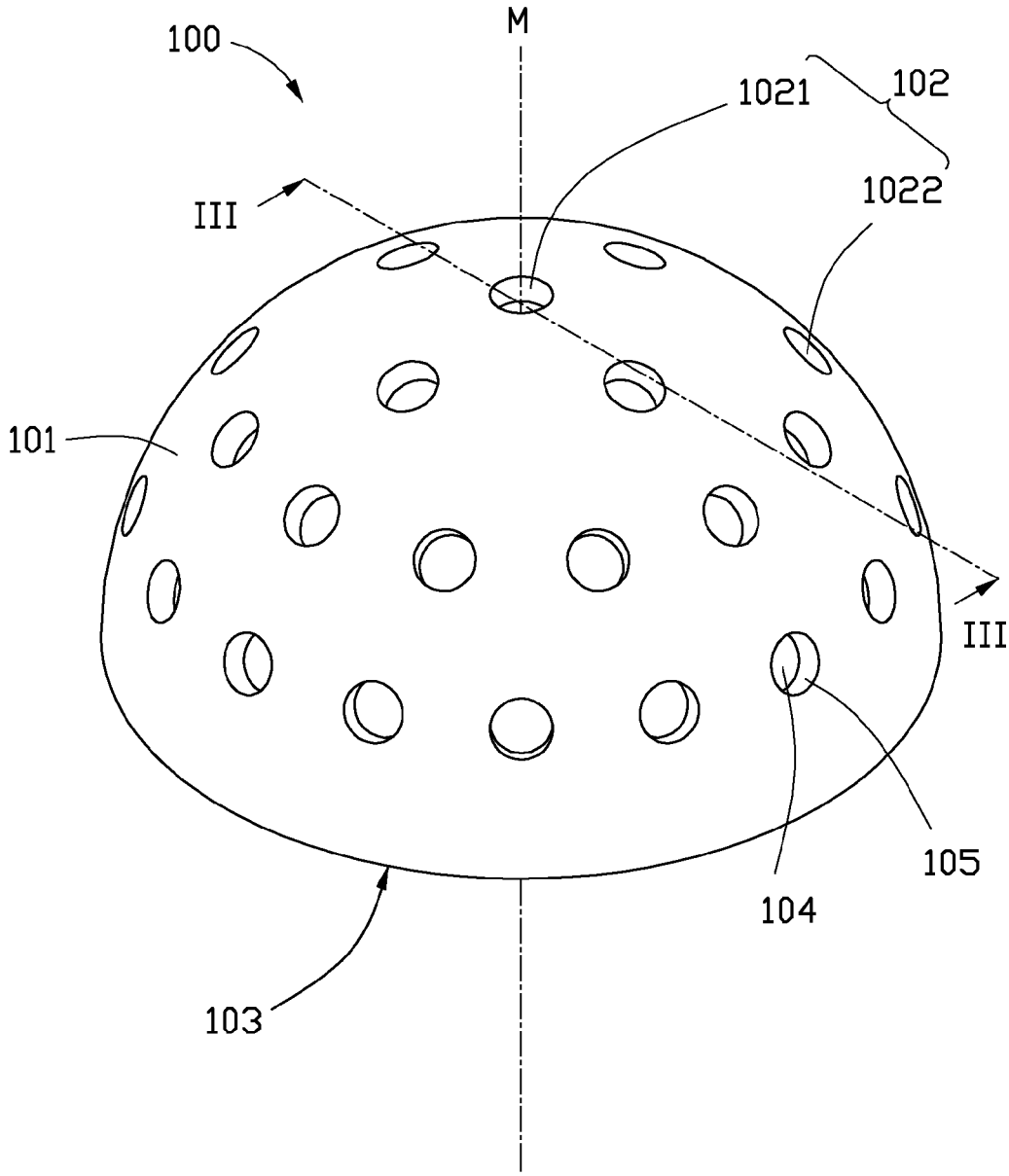
FIG. 1 is an isometric view of a light source holder, according to a first embodiment.
Figure 2:
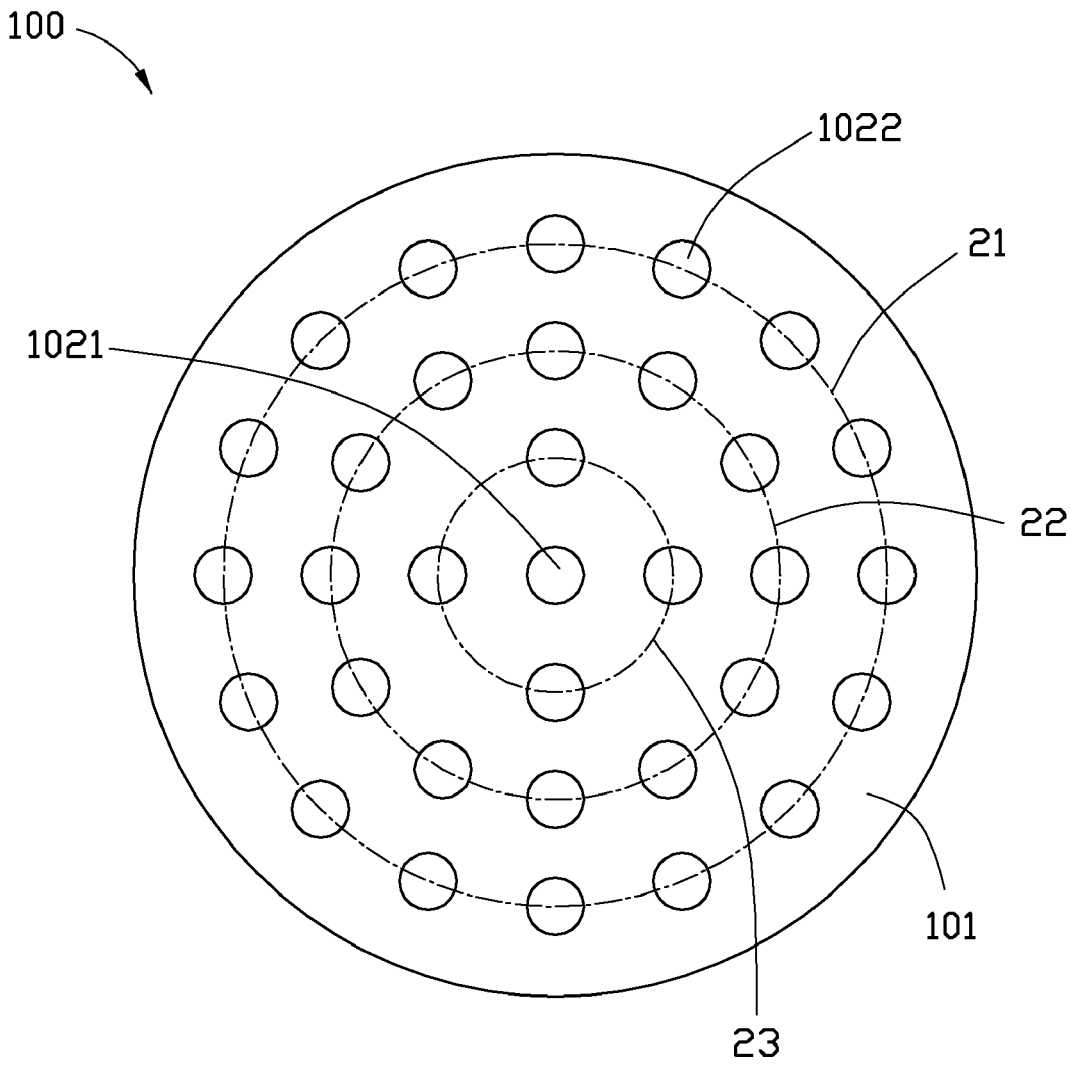
FIG. 2 is a top plan view of the light source holder of FIG. 1.
Figure 3:
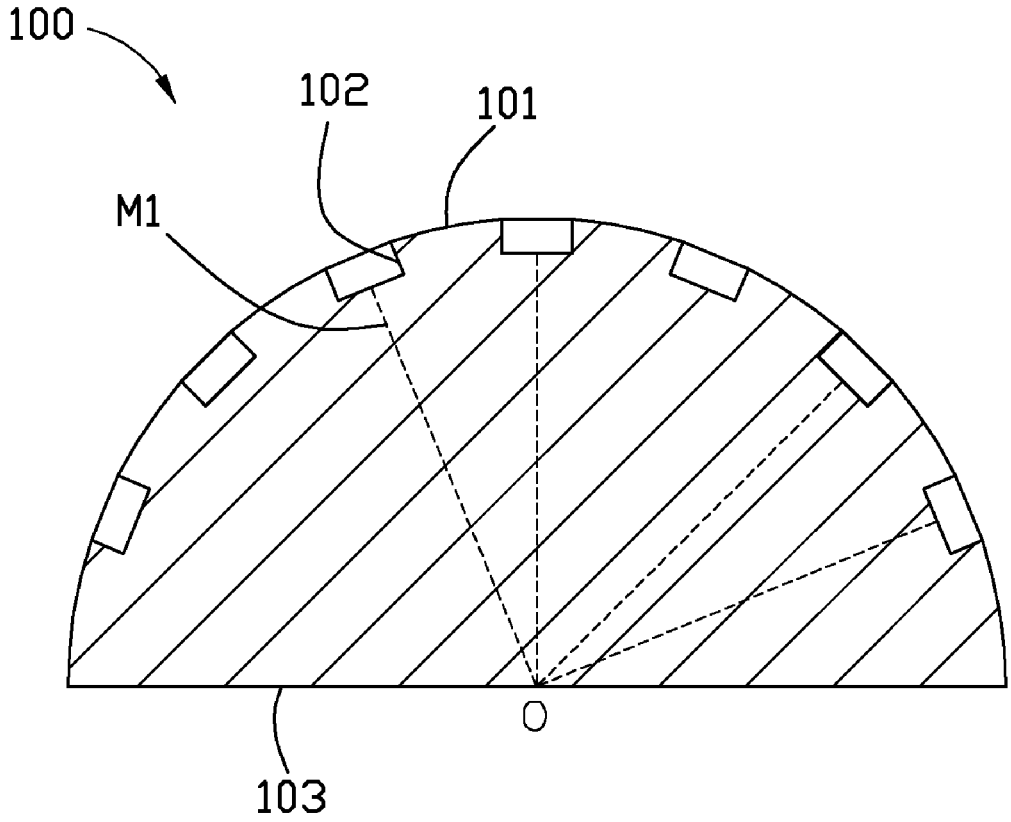
FIG. 3 is a cross section of the light source holder of FIG. 1 taken from line III-III thereof.

Referring to FIGS. 1-3, a light source holder 100, according to a first embodiment, is configured for holding a plurality of solid-state light sources (not shown) thereon. The light source holder 100 has a spherical surface 101, and a lower surface 103 adjoining the spherical surface 101. The spherical surface 101 has a center O, and a holder central axis M passing through the center O. In this embodiment, the light source holder 100 has a hemispherical shape, therefore the spherical surface 101 is a hemispherical surface. The lower surface 103 is a flat surface.

The spherical surface 101 has a plurality of recessed portions 102 defined therein. The recessed portions 102 include one first recessed portion 1021 and a plurality of second recessed portions 1022. The first recessed portion 1021 is defined at a position corresponding to a vertex of the spherical surface 101. The second recessed portions 1022 surround the holder central axis M of the spherical surface 101. In a typical arrangement, the second recessed portions 1022 are evenly distributed along at least one imaginary circle on the spherical surface 101. The center of the at least one imaginary circle is on the holder central axis M. In this embodiment, the at least one imaginary circle includes three neighboring imaginary circles, which are a first imaginary circle 21, a second imaginary circle 22, and a third imaginary circle 23. The first, the second, and the third imaginary circles 21~23 can be considered as parallels of latitude of the spherical surface 101. That is, the first, the second, and the third imaginary circles 21~23 are parallel to each other, and arranged in sequence in a direction along the holder central axis M of the spherical surface 101. The third imaginary circle 23 is nearest to the vertex of the spherical surface 101, and the first imaginary circle 21 is farthest from the vertex of the spherical surface 101.

The light source holder 100 has a plurality of inner surfaces in the recessed portions 102. The inner surface in each recessed portion 102 includes a bottom surface 104, and a lateral reflective surface 105 adjoining the bottom surface 104. The bottom surface 104 is configured for having a solid-state light source mounted thereon. The solid-state light source can for example be an LED, an LED chip, or another suitable type of solid-state light source. The lateral reflective surface 105 is configured for reflecting light from the solid-state light source, so that the light is output from the recessed portion 102 to illuminate a predetermined area. Thus, the light utilization efficiency of all the solid-state light sources can be improved. In the first embodiment, each recessed portion 102 is a substantially circular (or cylindrical) recessed portion. The bottom surface 104 is a round flat surface, and defines a recessed portion central axis M1. The recessed portion central axis M1 is perpendicular to the bottom surface 104, and passes through the center O of the spherical surface 101, as shown in FIG. 3. The lateral reflective surface 105 is circular or cylindrical. In alternative embodiments, the recessed portions 102 may have other shapes, for example, substantially frusto-conical shapes, substantially cuboid shapes, etc. When the recessed portions 102 are frusto-conical, they may be circular frusto-conical shaped, and taper from the spherical surface 101 to the bottom surface 104.

The first, the second, and the third imaginary circles 21~23 have different numbers of second recessed portions 1022 arranged thereon. The number of second recessed portions 1022 in each imaginary circle 21~23 increases as the radiuses of the three imaginary circles 21~23 increase. Thus, the solid-state light sources arranged in the second recessed portions 1022 cooperate with the solid-state light source arranged in the first recessed portion 1021 to form an illuminating region, in which all the solid-state light sources are generally evenly distributed. In this embodiment, the first imaginary circle 21 has four second recessed portions 1022 arranged thereon. The second imaginary circle 22 has twelve second recessed portions 1022 arranged thereon. The third imaginary circle 23 has sixteen second recessed portions 1022 arranged thereon.

Figure 4:
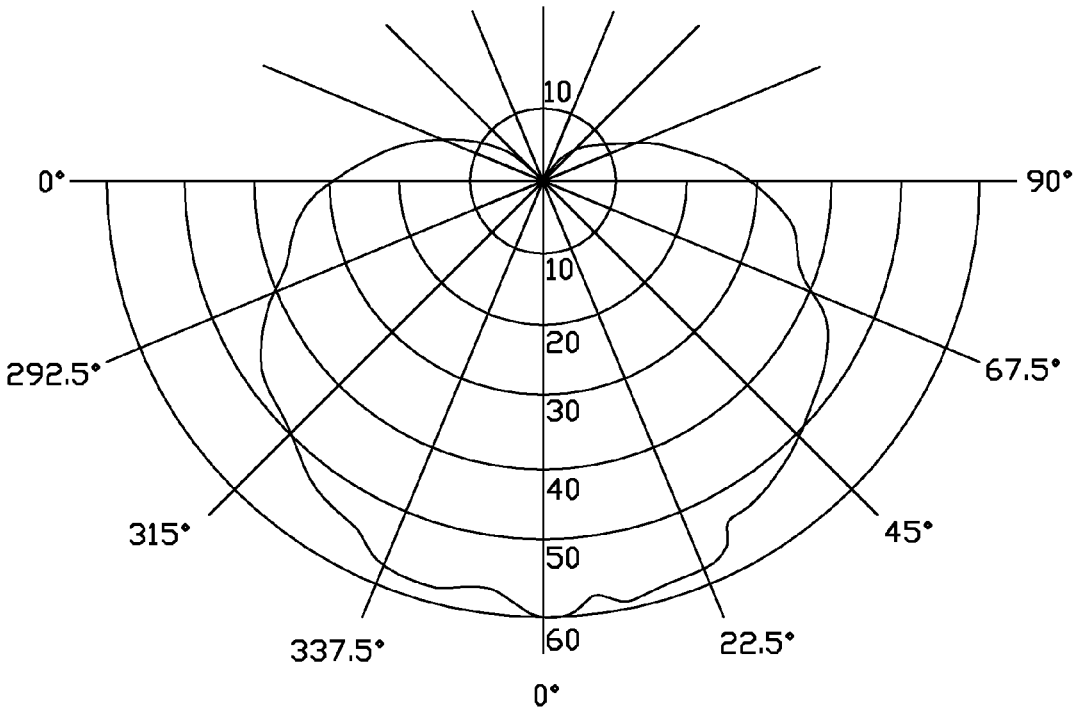
FIG. 4 is a light intensity distribution diagram of the light source holder of FIG. 1 when the light source holder has a plurality of LEDs arranged therein.

FIG. 4 is a light intensity distribution diagram of the light source holder 100 when the light source holder 100 has a plurality of LEDs arranged in the recessed portions 102. The Full Width at Half Maximum (FWHM) is in a range from about 0 degrees to approximate 67.5 degrees, and in a range from about 292.5 degrees to about 360 degrees. That is, the FWHM of the LEDs mounted on the light source holder 100 is about 135 degrees. In addition, the light intensity in the FWHM region is substantially uniform. Therefore, the LEDs mounted on the light source holder 100 have a large radiating range and cooperate to provide uniform light. The light source holder 100, together with the LEDs mounted thereon may be applied in locations where a large radiating range and uniform light is needed, such as a dance stage.

The light source holder 100 can be made of insulating material, such as plastic. In such case, the lateral surface 105 of each recessed portion 102 can be coated with reflective material. Alternatively, the light source holder 100 can be made of metallic material with good reflection capability and high thermal conductivity, such as aluminum, copper, an alloy thereof, or another suitable metal or alloy. In such case, heat from the solid-state light sources can be transferred to the light source holder 100, and then dissipated to ambient air.

Figure 5:
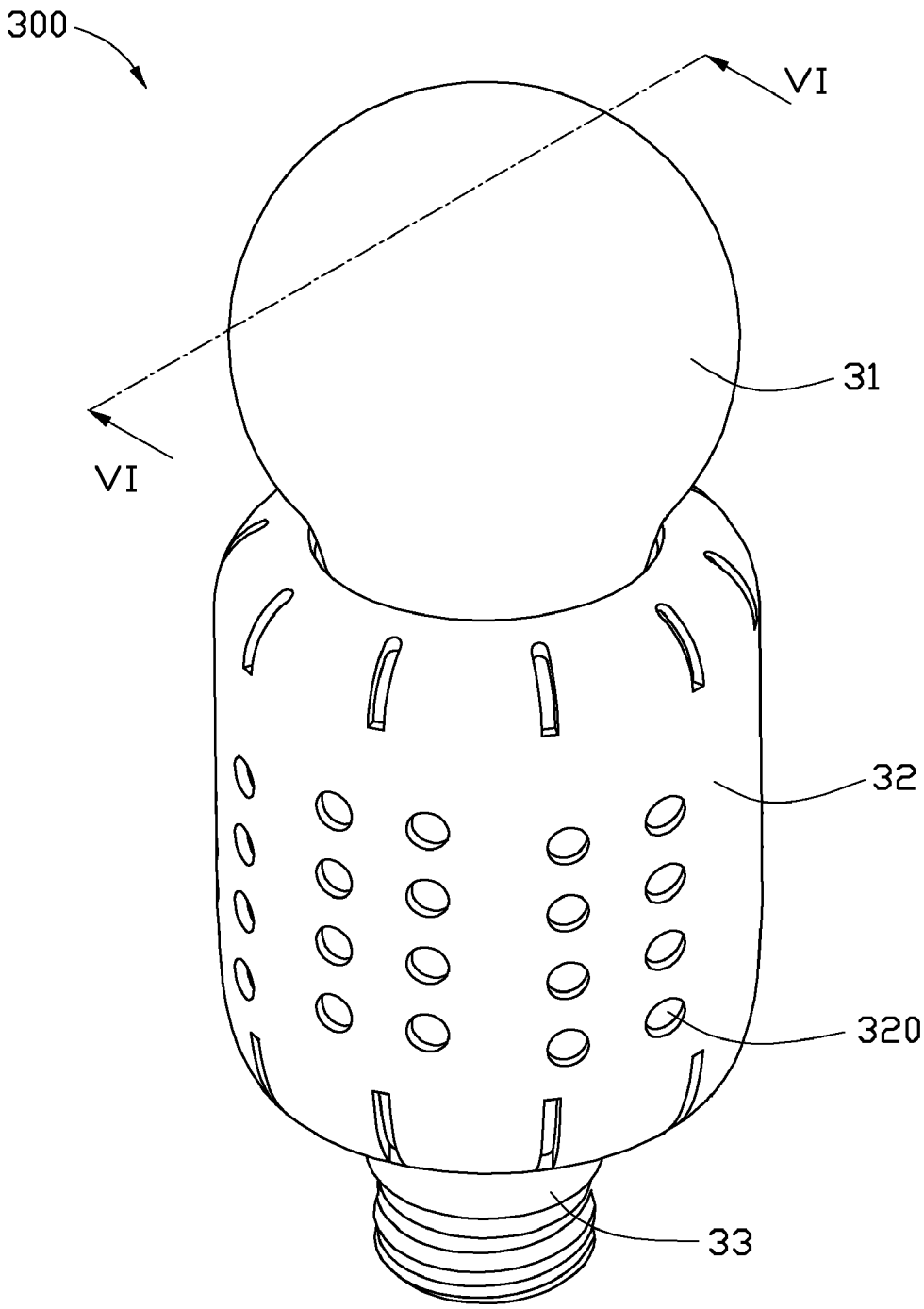
FIG. 5 is an isometric view of a bulb, according to a second embodiment, the bulb using the light source holder of FIG. 1.
Figure 6:
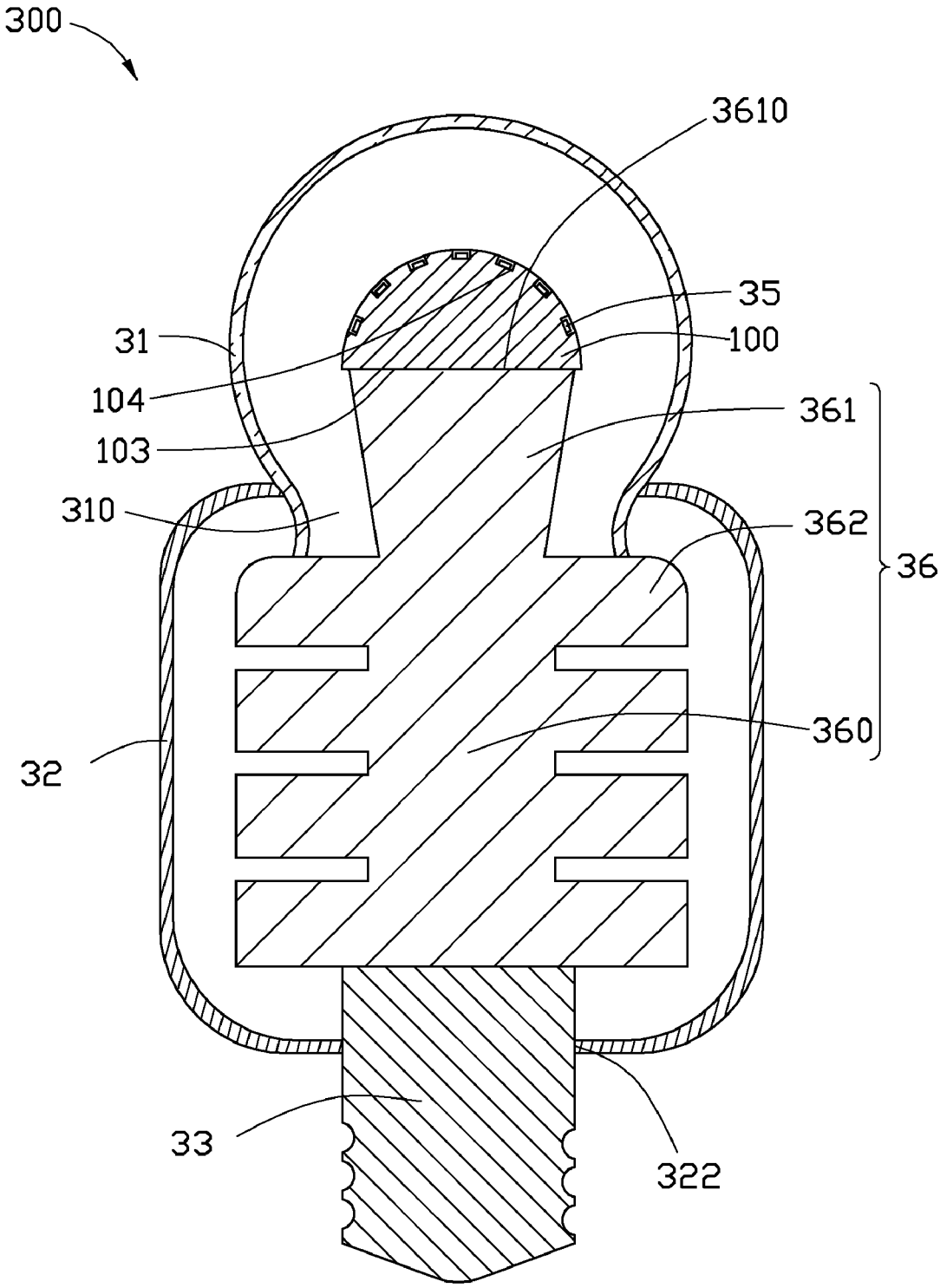
FIG. 6 is a cross section of the bulb of FIG. 5 taken from line VI-VI thereof.

Referring to FIGS. 5 and 6, a bulb 300, in accordance with a second embodiment, is shown. The bulb 300 includes at least a lampshade 31, a shell 32, a bulb holder 33, the light source holder 100, and a plurality of solid-state light sources 35. The bulb 300 may further include a heat dissipation device 36 for dissipating heat from the solid-state light sources 35.

The solid-state light sources 35 are mounted in the recessed portions 102 of the light source holder 100. In particular, each solid-state light source 35 is mounted on the bottom surface 104 of a respective recessed portion 102 of the light source holder 100.

The lampshade 31 is a light-pervious spherical cover, which receives and protects the light source holder 100 with the solid-state light sources 35 mounted thereon. The lampshade 31 has a first opening 310 at a bottom thereof. In operation, light emitted from the solid-state light sources 35 passes through the lampshade 31 to the ambient environment.

The shell 32 is a generally cylindrical chamber attached to the bottom of the lampshade 31 near the first opening 310. The shell 32 communicates with the lampshade 31 via the first opening 310, and receives and protects the heat dissipation device 36. The heat dissipation device 36, for example, may include a cylindrical main body 360 received in the shell 32, a top supporting portion 361, and a plurality of peripheral protrusions 362. The supporting portion 361 extends from a top end of the main body 360 through the first opening 310 into the lampshade 31, and supports the light source holder 100. In the illustrated embodiment, the supporting portion 361 has a frusto-conical shape, with a flat end surface 3610 at the top. The light source holder 100 is coupled to the supporting portion 361, with the lower surface 103 intimately contacting the end surface 3610. Alternatively, an adhesive layer can be provided between the lower surface 103 and the end surface 3610 for coupling the light source holder 100 to the supporting portion 361.

The protrusions 362 are arranged around the main body 360 in a plurality of rings. The rings are evenly spaced apart from each other. Each protrusion 362 extends radially from the main body 360. The protrusions 362 in each ring are spaced apart from each other, and are evenly distributed around the ring. In a typical application, heat from the solid-state light sources 35 can be transferred from the light source holder 100 to the protrusions 362 via the main body 360. The protrusions 362 increase a total surface area of the heat dissipation device 36 which is in contact with air. Thus, the heat dissipating efficiency of the bulb 300 is improved. To help the protrusions 362 contact ventilating air, the shell 32 may have a plurality of through holes 320 defined therein. In the illustrated embodiment, the through holes 320 are positioned opposite to the protrusions 362, respectively.

The shell 32 may have a second opening 322 defined in a bottom end thereof. Thus the shell 32 may fittingly receive the bulb holder 33 in the second opening 322. The bulb holder 33 is electrically connected to the solid-state light sources 35. Thus, electric current can be applied to the solid-state light sources 35 by connecting the bulb holder 33 to an exterior power supply (not shown). The bulb holder 33, for example, can be an Edison screw holder, a bayonet cap, or another suitable type of bulb holder.

It is to be understood that the above-described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

What is claimed is:

1. A light source holder comprising:

a spherical surface with a plurality of recessed portions defined therein, the recessed portions being arranged substantially evenly over the spherical surface;

each of the recessed portions comprising a plurality of inner surfaces, the inner surface of each recessed portion comprising a bottom surface capable of having a solid-state light source arranged thereon, and a lateral reflective surface adjacent to the bottom surface and configured for reflecting light emitted from the solid-state light source and outputting the light from the recessed portion;

wherein the light source holder is made of metallic material.

2. The light source holder of claim 1, wherein the spherical surface defines a center, and a holder central axis passing through the center of the spherical surface, the bottom surface in each recessed portion defines a surface central axis passing through the center of the spherical surface.

3. The light source holder of claim 2, wherein the recessed portions comprises a first recessed portion defined in the spherical surface at a position corresponding to a vertex of the spherical surface, and a plurality of second recessed portions evenly distributed on at least one imaginary circle on the spherical surface, with the center of the at least one imaginary circle being on the holder central axis.

4. The light source holder of claim 3, wherein the at least one imaginary circle comprises a plurality of parallel imaginary circles arranged in sequence along a direction of the holder central axis of the spherical surface, and the number of second recessed portions in each imaginary circle increases as a radiuses of the imaginary circles increase.

5. The light source holder of claim 1, wherein each recessed portion has one of a substantially cylindrical shape, a substantially cuboid-shape, and a substantially frusto-conical shape.

6. The light source holder of claim 1, wherein the light source holder has a hemispherical shape, and the spherical surface is a hemispherical surface.

7. The light source holder of claim 1, wherein the metallic material is comprised of one of aluminum, copper, and aluminum-copper alloy.

8. A bulb comprising:

a light source holder having a spherical surface, the spherical surface having a plurality of recessed portions defined therein, the recessed portions being arranged substantially uniformly over the spherical surface, each of the recessed portions comprising a plurality of inner surfaces, the inner surface of each recessed portion comprising a bottom surface and a lateral reflective surface adjacent to the bottom surface;

a plurality of solid-state light sources arranged on the bottom surfaces of the recessed portions, respectively, wherein each lateral reflective surface is capable of reflecting light emitted from the solid-state light source so that the light is output from the recessed portion, and all the light sources outputting light from all the recessed portions cooperatively provide substantially uniform light;

a light-pervious lampshade receiving the light source holder with the solid-state light sources; and a bulb holder electrically connected to the solid-state light sources.

9. The bulb of claim 8, wherein the light source holder is made of metallic material.

10. The bulb of claim 9, further comprising a heat dissipation device coupled between the light source holder and the bulb holder and structured and arranged for dissipating heat generated from the solid-state light sources.

11. The bulb of claim 10, further comprising a shell coupled to the lampshade, the shell and the lampshade cooperatively receiving the heat dissipation device.

12. The bulb of claim 11, wherein the lampshade is coupled to one end of the shell, and the bulb holder is coupled to an opposite end of the shell.

13. The bulb of claim 10, wherein the heat dissipation device comprises:

an elongated main body;

a supporting portion extending from an end of the main body and supporting the light source holder; and a plurality of protrusions arranged around the elongated main body in a plurality of rings, the rings being evenly spaced apart from each other, and each protrusion extending radially from the main body.

14. The bulb of claim 13, wherein the light source holder further comprises a lower surface adjacent to the spherical surface, and the supporting portion has a flat end surface intimately contacting the lower surface of the light source holder.

15. The bulb of claim 8, wherein the light source holder has a hemispherical shape, and the spherical surface is a hemispherical surface.

16. The bulb of claim 8, wherein the solid-state light sources are selected from the group consisting of light emitting diodes and light emitting diode chips.

17. The bulb of claim 8, wherein the bulb holder comprises one of an Edison screw holder and a bayonet cap.

18. The bulb of claim 8, wherein the spherical surface defines a center, and a holder central axis passing through the center of the spherical surface, and the bottom surface of each recessed portion defines a recessed portion central axis passing through the center of the spherical surface.

19. The bulb of claim 8, wherein the recessed portions comprises a first recessed portion defined in the spherical surface at a position corresponding to a vertex of the spherical surface, and a plurality of second recessed portions evenly distributed on at least one imaginary circle on the spherical surface, with the center of the at least one imaginary circle being on the holder central axis.

* * * * *